US005521981A

United States Patent [19]

Gehring

[11] Patent Number: 5,521,981

[45] Date of Patent: May 28, 1996

[54] SOUND POSITIONER

[76] Inventor: Louis S. Gehring, 9 Downing Rd., Hanover, N.H. 03755

[21] Appl. No.: 178,045

[22] Filed: Jan. 6, 1994

[51] Int. Cl.[6] ..... H04S 5/00

[52] U.S. Cl. ..... 381/17; 381/25; 381/26

[58] Field of Search ..... 381/17, 24, 25, 381/26

[56] References Cited

U.S. PATENT DOCUMENTS

| | | | |
|---|---|---|---|
| 4,893,342 | 1/1990 | Cooper et al. | 381/26 |
| 5,046,097 | 9/1991 | Lowe et al. | 381/17 |
| 5,105,462 | 4/1992 | Lowe et al. | 381/17 |
| 5,333,200 | 7/1994 | Cooper | 381/25 |
| 5,371,799 | 12/1994 | Lowe et al. | 381/17 |
| 5,404,406 | 4/1995 | Fuchigami et al. | 381/17 |
| 5,438,623 | 8/1995 | Begault | 381/17 |
| 5,440,639 | 8/1995 | Suzuki et al. | 381/17 |
| 5,459,790 | 10/1995 | Scofield et al. | 381/25 |

*Primary Examiner*—Edward L. Coles, Sr.
*Assistant Examiner*—Jerome Grant, II
*Attorney, Agent, or Firm*—Devine, Millimet & Branch

[57] ABSTRACT

This invention relates to the presentation of sound where it is desirable for the listener to perceive one or more sounds as coming from specified three-dimensional spatial locations. In particular, this invention provides economical means of presenting three dimensional binaural audio signals with adjustment of spatial positioning parameters in real time.

19 Claims, 3 Drawing Sheets

| DIRECTION–DEGREES | | VOLUME SETTINGS–PERCENT | | | |
|---|---|---|---|---|---|
| | | FRONT | IPSILATERAL | REAR | CONTRALATERAL |
| 0 | LEFT | 100 | 0 | 0 | 0 |
| | RIGHT | 100 | 0 | 0 | 0 |
| 10 | LEFT | 89 | 0 | 0 | 11 |
| | RIGHT | 89 | 11 | 0 | 0 |
| 45 | LEFT | 50 | 0 | 0 | 50 |
| | RIGHT | 50 | 50 | 0 | 0 |
| 90 | LEFT | 0 | 0 | 0 | 100 |
| | RIGHT | 0 | 100 | 0 | 0 |
| 180 | LEFT | 0 | 0 | 100 | 0 |
| | RIGHT | 0 | 0 | 100 | 0 |
| 255 | LEFT | 0 | 83 | 17 | 0 |
| | RIGHT | 0 | 0 | 17 | 83 |
| 270 | LEFT | 0 | 100 | 0 | 0 |
| | RIGHT | 0 | 0 | 0 | 100 |

SOUND POSITIONER

BACKGROUND OF THE INVENTION

Human hearing is spatial and three-dimensional in nature. That is, a listener with normal hearing knows the spatial location of objects which produce sound in his environment. For example, in FIG. 1 the individual shown could hear the sound at S1 upward and slightly to the rear. He senses not only that something has emitted a sound, but also where it is even if he can't see it. Natural spatial hearing is also called binaural hearing; it allows us to near the musicians in an orchestra in their separate locations, to separate the different voices around us at a cocktail party, and to locate an airplane flying overhead.

Scientific literature relating to binaural hearing shows that the principal acoustic features which make spatial hearing possible are the position and separation of the ears on the head and also the complex shape of the pinnae, the external ears. When a sound arrives, the listener senses the direction and distance of its source by the changes these external features have made in the sound when it arrives as separate left arid right signals at the respective eardrums. Sounds which have been changed in this manner can be said to have binaural location cues: when they are heard, the sounds seem to come from the correct three-dimensional spatial location. As any listener can readily test, our natural binaural hearing allows hearing many sounds at different locations all around and at the same time.

Binaural sound and commercial stereophonic sound are both conveyed with two signals, one for each ear. The difference is that commercial stereophonic sound usually is recorded without spatial location cues; that is, the usual microphone recording process does not preserve the binaural cuing required for the sound to be perceived as three-dimensional. Accordingly, normal stereo sounds on headphones seem to be inside the listener's head, without any fixed location, whereas binaural sounds seem to come from correct locations outside the head, just as if the sounds were natural.

There are numerous applications for binaural sound, particularly since it can be played back on normal stereo equipment. Consider music where instruments are all around the listener, moved or "flown" by the performer; video games where friends or foes can be heard coming from behind; interactive television where things can be heard approaching offscreen before they appear; loudspeaker music playback where the instruments can be heard above or below the speakers and outside them.

One well-known early development in this field consisted of a dummy head ("kunstkopf") with two recording microphones in realistic ears: binaural sounds recorded with such a device can be compellingly spatial and realistic. A disadvantage of this method is that the sounds' original spatial locations can be captured, but not edited or modified. Accordingly, this earlier mechanical means of binaural processing would not be useful, for example, in a videogame where the sound needs to be interactively repositioned during game play or in a cockpit environment where the direction of an approaching missile and its sound could not be known in advance.

Recent developments in binaural processing use a digital signal processor (DSP) to mathematically emulate the dummy head process in real time but with positionable sound location. Typically, the combined effect of the head, ear, and pinnae are represented by a left-right pair of head-related transfer functions (HRTFs) corresponding to spherical directions around the listener, usually described angularly as degrees of azimuth and elevation relative to the listener's head as indicated in FIG. 1. The said HRTFs may arise from laboratory measurements or may be derived by means known to those skilled in the art. By then applying a mathematical process known as convolution wherein the digitized original sound is convolved in real time with the left- and right-ear HRTFs corresponding to the desired spatial location, right- and left-ear binaural signals are produced which, when heard, seem to come from the desired location. To reposition the sound, the HRTFs are changed to those for the desired new location. FIG. 2 is a block diagram illustrative of a typical binaural processor.

DSP-based binaural systems are known to be effective but are costly because the required real time convolution processing typically consumes about ten million instructions per second (MIPS) signal processing power for each sound. This means, for example, that using real time convolution to create the binaural sounds for a video game with eight objects, not an uncommon number, would require over eighty MIPS of signal processing. Binaurally presenting a musical composition with thirty-two sampled instruments controlled by the Musical Instrument Digital Interface (MIDI) would require over three hundred MIPS, a substantial computing burden.

The present invention was developed as an economical means to bring these applications and many others into the realm of practicality. Rather than needing a DSP and real time binaural convolution processing, the present invention provides means to achieve real time, responsive binaural sound positioning with inexpensive small computer central processing units (CPUs), typical "sampler" circuits widely used in the music and computer sound industries, or analog audio hardware.

SUMMARY OF THE INVENTION

A sound positioning apparatus comprising means of playing back binaural sounds with three-dimensional spatial position responsively controllable in real time and including means of preprocessing the said sounds so they can be spatially positioned by the said playback means. The burdensome processing task of binaural convolution required for spatial sound is performed in advance by the preprocessing means so that the binaural sounds are spatially positionable on playback without significant processing cost.

DETAILED DESCRIPTION OF THE INVENTION

PREPROCESSING MEANS

In accordance with the principles of the present invention, a binaural convolution processing means (the "preprocessor") is used to generate multiple binaurally processed versions ("preprocessed versions") of the original sound where each preprocessed version comprises the sound convolved through HRTFs corresponding to a different predefined spherical direction (or, interchangeably, point on a surrounding sphere rather than "spherical direction"). The number and spherical directions of preprocessed versions are as required to cover, that is enclose within great circle segments connecting the respective points on the surrounding sphere, the part of the sphere around the listener where it will be desirable to position the sound on playback.

In one example six preprocessed versions having twelve left- and right-ear binaural signals could be generated to cover the whole sphere as follows: front (0° azimuth, 0° elevation); right (90° azimuth, 0° elevation); rear (180° azimuth, 0° elevation); left (270° azimuth, 0° elevation), top (90° elevation); and bottom (–90° elevation). This configuration would be useful for applications such as air combat simulation where sounds could come from any spherical direction around the pilot. In another example, only three similarly preprocessed versions would be required to cover the forward half of the horizontal plane as follows: left, front, and right. This arrangement would require only half the preprocessed data of the previous example and would be sufficient for presenting the sound of a musical instrument appearing anywhere on a level stage where elevation is not needed. A third example, responsive to the requirements of some three-dimensional video games, would use five similarly preprocessed versions corresponding to the front, right, rear, left, and top to allow sounds to come from anywhere in the upper hemisphere. In this example five-sixths of the preprocessed data of the first example would be generated.

Figure 1:
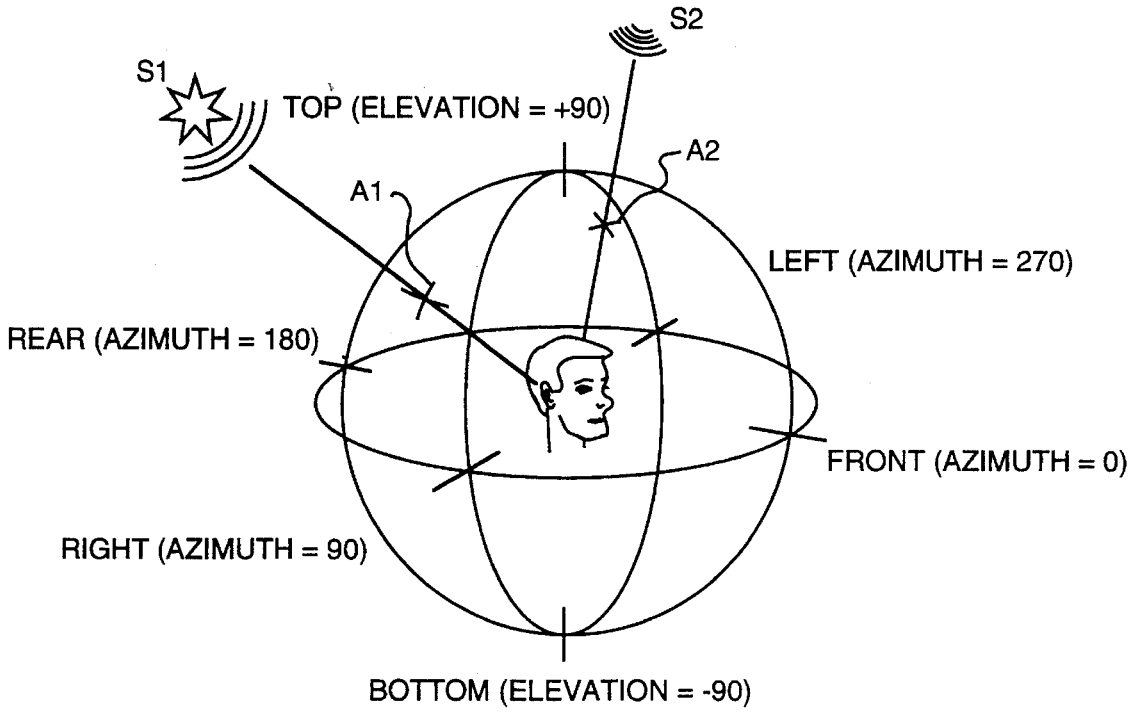
FIG. 1 is a drawing illustrating the usual angular coordinate system for spatial sound.
Figure 2:
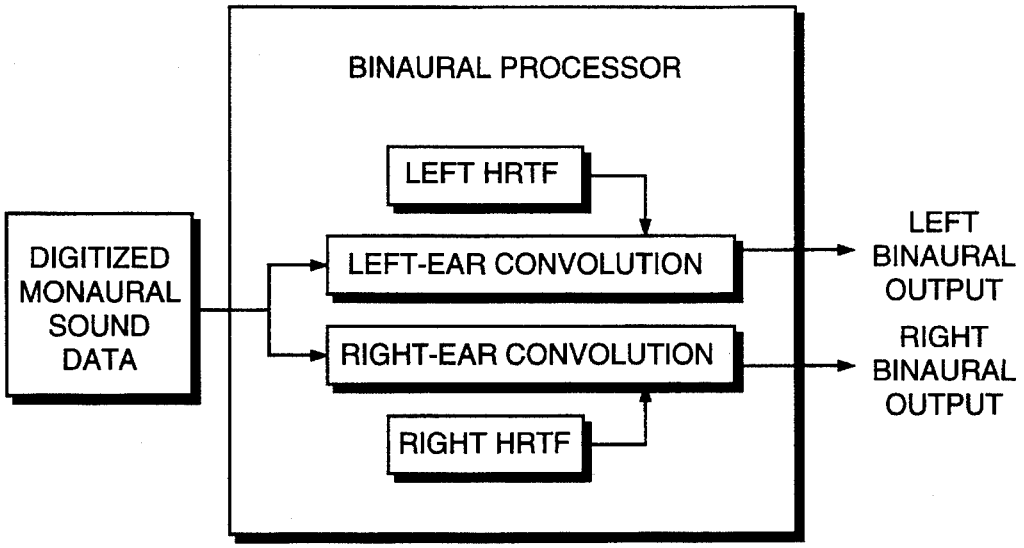
FIG. 2 is a block diagram of a typical binaural convolution processor.

These preceding three examples use preprocessed versions positioned rectilinearly at 90° increments. Obviously coverage of all or part of the sphere could also be achieved by many other arrangements; for example, a regular tetrahedron of four preprocessed versions would cover the whole sphere. Although such other arrangements are usable within the scope of the present invention, arrangements like the first three examples which are bilaterally symmetrical are the preferred embodiment because they have an advantage which arises in the following manner:

Normal human spatial hearing is known to be bilaterally symmetrical, i.e. the directional responses of the left and right ears are approximate mirror images in azimuth. This attribute makes it possible to move a sound to the mirror-image location in the opposite lateral hemisphere by simply reversing the binaural signals applied to the listener's left and right eardrums. In FIG. 1, for example, the spatial sound shown at S1 and having an angular position indicated at A1 will seem to move to the mirror-image position S2 with the mirrored azimuthal angle A2 if the left and right signals are reversed.

In the terms usual in the binaural art, it is said that sound directions are ipsilateral (i.e. near-side; louder) or contralateral (i.e. far-side; quieter) with respect to a single ear; equilateral directions such as front, top, rear, and bottom are said to lie in the median plane. In a preferred embodiment of the present invention, preprocessed versions are generated and stored as single ipsilateral, contralateral, or median-plane signals rather than as specifically left- or right-ear signals. On playback, the apparatus of the PLAYBACK MEANS determines from the desired direction how to apply the ipsilateral, contralateral, and median-plane signals appropriately to the listener's left and right ears. Thus in the said embodiment the redundant storage of mirror-image data is avoided and half the number of preprocessed signals are required.

Figure 3:
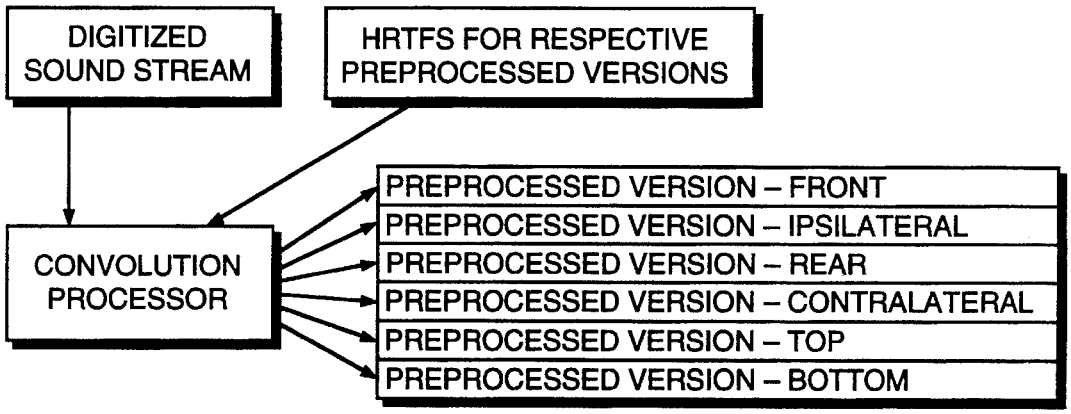
FIG. 3 is a block diagram illustrating preprocessing means.

In the said preferred embodiment of the invention, the three examples given above could then be redefined as follows: for the first example covering the whole sphere, the six preprocessed versions, each now comprising only one binaural signal rather than two, would consist of front; ipsilateral; rear; contralateral; top; bottom. FIG. 3 illustrates the arrangement of preprocessing means to generate the said six preprocessed versions. The second example, covering the forward horizontal plane, would consist of contralateral; front; ipsilateral. Similarly the third example, covering the upper hemisphere, would consist of front; ipsilateral; rear; contralateral; top.

Preprocessed versions could be processed and stored for eventual playback in various ways depending on the embodiment of the present invention. When the preprocessing and playback hardware are typical of the digital audio art, for example, the preprocessor would usually be a program running in a small computer, reading, convolving, and outputting digitized sound data read from the computer's memory or disk. The respective preprocessed versions generated by the preprocessor program in this example might be stored together in memory or disk with their respective sound data samples presented sequentially or interleaved according to the hardware implementation of the PLAYBACK MEANS. In an embodiment of the invention relating to the analog audio art, the preprocessed versions could be created on tape or another analog storage medium either by transferring digitally preprocessed versions or by analog recording using a positionable kunstkopf to directly record the preprocessed versions at the desired spherical directions. Such an analog embodiment could be useful in, for example, toys where digital technology may be too costly.

Useful processes from areas of the audio art not necessarily related to the binaural art, for example equalization, surround-sound processing, or crosstalk cancellation processing for improved playback through loudspeakers, could be incorporated in the PREPROCESSING MEANS within the scope of the present invention.

PLAYBACK MEANS

Figure 4:
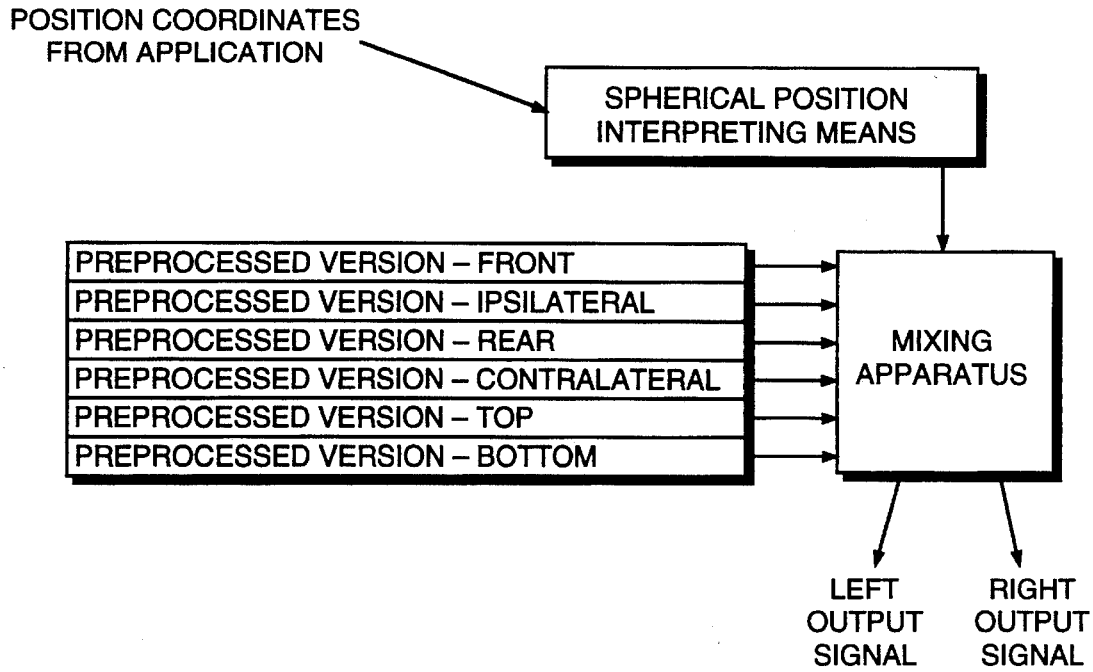
FIG. 4 is a block diagram illustrating playback means and spherical position interpreting means.

The PLAYBACK MEANS described in the present invention includes two principal components: a mixing apparatus and a spherical position interpreting means which controls the mixing apparatus so as to produce the desired output during playback. The functional arrangement of these components in an example with six preprocessed versions is shown schematically in FIG. 4.

The mixing apparatus would usually be of the type familiar in the audio art where a multiplicity of sounds, or audio streams, may be synchronously played back while being individually controlled as to volume and routing so as to produce a left-right pair of output signals which combine the thusly controlled and routed multiplicity of audio streams. One such mixing apparatus comprises a general-purpose CPU running a mixing program wherein digital samples corresponding to each sound stream are successively read, scaled as to loudness and routing according to the mix instructions, summed, and then transmitted to the digital-to-analog converter (DAC) appropriate to the desired left or right output. In a more specialized apparatus, "sampler" circuits perform similar functions where a large number of sampled signals, typically short digitized samples of the sounds of particular musical instruments, are played back simultaneously as multiple musical "voices"; sampler circuits often include associated memory dedicated to the storage of samples.

According to the present invention, one of the independently volume-and routing-controllable playback streams, or voices, of the mixing apparatus is used for for each preprocessed version created by the PREPROCESSING MEANS. Thus in the example from the preceding section where the six preprocessed versions covering the whole sphere are signals for the front, ipsilateral, rear, contralateral, top, and bottom, one voice is used for each signal making a total of six voices. Other examples could typically require from three to six voices.

The volume and routing controlling parameters for the said independently volume- and routing- controllable playback streams are derived from the position control commands received by the spherical position interpreting means in the following manner, using for reference the six-voice preferred embodiment covering the whole sphere referred to in the preceding paragraph:

The following simple rule set is used for routing the six voices, noting that the routing function is independent of volume control.

1. Median plane signals, i.e. front, top, rear, and bottom, are always routed equally to left and right outputs. Only their volume is adjustable.
2. Where azimuth is between 0° and 180°, the ipsilateral signal is routed to the right ear and the contralateral signal is routed to the left ear.
3. Where azimuth is between 180° and 360°, the ipsilateral signal is routed to the left ear and the contralateral signal is routed to the right ear.

Regarding volume control parameters for the respective signals, first consider the instance where the azimuth angle is changed but elevation remains at 0°. Throughout this instance the volume of the top and bottom voice volume settings remain at zero. The mixer volume control values derived from azimuth cause the front voice to be at full volume when azimuth is 0° and the sound is straight ahead. The ipsilateral, contralateral, and rear signals are set at zero volume. Since the sound is in the median plane the front voice is routed at full volume to both ears. When the azimuth is 90°, the front and rear voices are at zero volume and both the ipsilateral and contralateral signals are at full volume. Since a sound angle of 90° lies closer to the right ear, the ipsilateral signal is routed to the right output and the contralateral signal is routed to the left output. At a sound angle of 180° the ipsilateral, contralateral, and front signals are all at zero; the rear signal is presented at full volume to both ears. At 270° azimuth, the presentation is similar to 90° azimuth except that the ipsilateral signal is routed to the left ear and the contralateral signal to the right ear.

Figure 5:
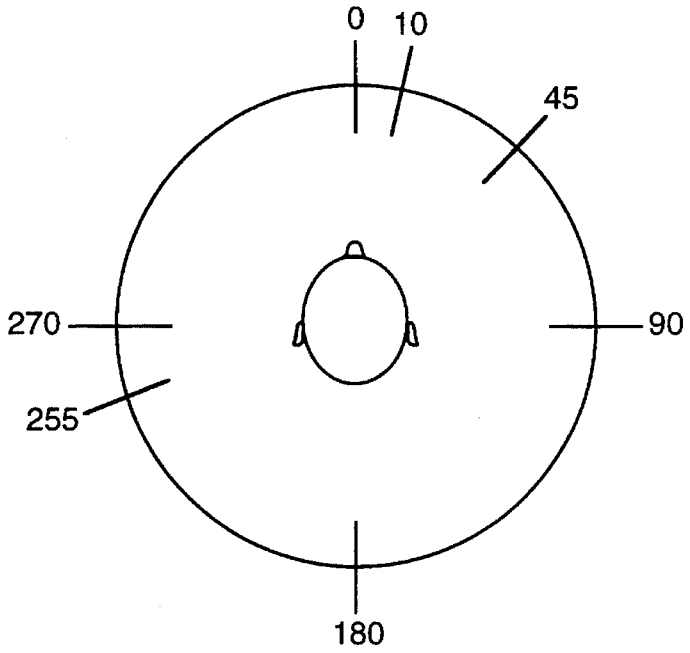
FIG. 5 is a drawing showing angular positions and a tabular chart of mixing apparatus control settings related to the said angular positions.

Intermediate angles, i.e. angles not exactly at the 90° increments of the preprocessed versions, are created by setting the relevant volumes linearly in proportion to angular position within the respective 90° sector. For instance, an angle of 45°, halfway between 0° and 90°, is achieved by setting the front, near-ear, and far-ear volumes all at 45/90 or 50% volume. An angle of 10° requires settings of 80/90 or about 89% of full volume for the front and 10/90 or about 11% of full volume for the ipsilateral and contralateral voices. An angle of 255°, or 75° within the sector between 180° and 270°, requires settings of 15/90 or 17% of full volume for the rear voice and 75/90 or 83% of full volume for the ipsilateral and contralateral voices. FIG. 5 shows a tabulated chart of azimuth angles with their respective routing and volume setting values as they apply to left and right outputs.

It is possible to resolve angles depending on the volume setting resolution of the mixing apparatus; if the mixing apparatus can resolve 512 discrete levels of volume, for example, each 90° quadrant can be resolved into 512 angular steps so that the angular resolution is 90/512 or about 0.176 degree. A mixing apparatus which can resolve 16 levels of volume would have an angular resolution of 90/16 or about 5.6°.

When the elevation angle is not zero, i.e. the sound moves above or below the horizontal plane, the volume and routing settings are derived as described above and an additional operation is added. The four already-derived horizontal-plane volume settings are attenuated proportional to absolute elevation angle, i.e. they linearly diminish to zero volume at +90° or −90° elevation. Simultaneously, the signal for the top preprocessed version or the bottom preprocessed version, depending on whether elevation is positive or negative, is increased linearly proportional to the absolute elevation. Thus at the top position (elevation 90°), for example, the top signal is routed at full volume to both ears according to the mixing rule set.

Distance control may be added in a final step after the mix volume settings are complete as described above; in one example, it would be set by modifying the left and right output volumes according to the usual natural physical model of inverse-radius-squared, i.e. with loudness inversely proportional to the square of the distance to the object. It is known to those skilled in the spatial hearing art that distance perception can be subjective; accordingly it may be desirable to use different models for deriving distance in various uses of the present patent.

The playback apparatus could include additional controllable effects which need not be related to the binaural art, in particular pitch shifting in which the played back sound is controllably shifted to a higher or lower pitch while maintaining the desired spatial direction or motion in accordance with the principles of the present invention. This feature would be particularly useful, for example, to convey the Doppler shift phenomenon common to fast-moving sound sources.

In a sufficiently powerful embodiment of the present invention including, for example, one or more musical sampler circuits, the mixing apparatus and spherical position interpreting means could be applied to independently position a multiplicity of sounds at the same time. For example, one typical sampler circuit with 24 voices could independently position four sounds where each sound comprises six preprocessed versions in accordance with the specification of the invention. In a system with a multiplicity of voices it may be desirable to perform sound positioning in some of the voices while reserving other voices for other operations.

At any moment during the playback of one positioned sound by the present invention, no more than four voices need to be active, i.e. in use at more than a zero volume. This occurs because the preprocessed versions opposite the sound's angular direction are silent; they are not required as part of the output signal. Accordingly it is possible by using a more complex route switching function to free momentarily silent voices for other uses and to use a maximum of four, rather than six, voices for each positioned sound.

In the spatial sound art, sound position is usually expressed as azimuth, elevation, and distance as illustrated in FIG. 1. Obviously positioning values could be specified in other coordinate systems, Cartesian x,y, and z values for example, could be used within the scope of the present invention.

There has thus been disclosed a sound positioning apparatus comprising means of playing back sounds with three-dimensional spatial position responsively controllable in real time and means of preprocessing the said sounds so they can be spatially positioned by the said playback means.

What is claimed is:

1. An apparatus for playing back sounds with three-dimensional spatial position controllable in real time comprising:

a preprocessing means for generating a plurality of binaurally preprocessed versions of an original sound, wherein each said binaurally preprocessed version is the result of convolving the original sound with a head related transfer function corresponding to a single predefined point on a sphere surrounding a listener;

a storage means for storing said binaurally preprocessed versions of said sound; and a playback means comprising a means for mixing said binaurally preprocessed versions on playback to produce a left and right pair of binaural output signals conveying a desired three-dimensional spatial sound position and position interpreting means to translate said desired three-dimensional spatial sound position into control commands to control said mixing apparatus to produce said desired output signals during playback.

2. The apparatus of claim 1 wherein each said predefined point on said sphere surrounding said listener has an azimuth and an elevation spaced rectilinearly, at substantially 90 degree increments with respect to each other predefined spherical position.

3. The apparatus of claim 1 wherein at least two of said binaurally preprocessed versions of said signal are bilaterally symmetrical in azimuth.

4. The apparatus of claim 3 wherein two of said bilaterally symmetrical, binaurally preprocessed versions are ipsilateral and contralateral binaural versions of said original sound.

5. The apparatus of claim 1 wherein said preprocessed versions of said binaural signal comprise ipsilateral, contralateral and median plane versions.

6. The apparatus of claim 5 wherein said median plane versions comprise front, top, rear, and bottom versions.

7. The apparatus of claim 1 wherein said mixing means further comprises a means for adjusting volume and routing of said binaurally preprocessed versions to each of said left and right binaural output signals in proportion to said desired three-dimensional spatial sound position.

8. The apparatus of claim 7, wherein said proportional control is linear in proportion to a spherical position intermediate said predefined spherical positions.

9. The apparatus of claim 7, wherein said volume adjusting means for further controls the volume of said left and right pair of binaural output signals in unison to provide control of a perceived distance.

10. The apparatus of claim 1, wherein said playback means further comprises a means to controllably shift sound pitch while maintaining the desired three-dimensional spatial sound position.

11. A method for playing back sounds with three-dimensional spatial position controllable in real time comprising the steps of:

preprocessing an original sound to generate a plurality of binaurally preprocessed versions of said sound, wherein each said binaurally preprocessed version is the result of convolving the original sound with a head related transfer function corresponding to a single predefined point on a sphere surrounding a listener;

storing said binaurally preprocessed versions of said original sound;

interpreting and translating a desired three-dimensional spatial coordinate position into control commands;

mixing said binaurally preprocessed versions of said original sound according to said control commands to produce a left and right pair of binaural output signals conveying said desired three-dimensional spatial coordinate position; and playing back said left and right pair of binaural output signals on a playback means.

12. The method of claim 11 wherein preprocessing creates at least two preprocessed versions of said sound, which are bilaterally symmetrical.

13. The method of claim 12 wherein two of said bilaterally symmetrical, binaurally preprocessed versions are ipsilateral and contralateral versions of said sound.

14. The method of claim 13 wherein preprocessing creates a plurality of binaurally preprocessed versions of said sound comprising ipsilateral, contralateral and median plane versions.

15. The method of claim 14 wherein said median plane versions created comprise front, top, rear, and bottom versions.

16. The method of claim 11 wherein the step of mixing further comprises the steps of volume adjusting each binaurally preprocessed version in real time in proportion to said desired spatial coordinate position and routing each volume adjusted, binaurally preprocessed version to said left and fight pair of binaural output signals.

17. The method of claim 16, wherein said real-time volume adjustment is performed in linear proportion to a three-dimensional spatial coordinate position intermediate said predefined spatial coordinate positions.

18. The method of claim 17 further comprising the step of volume adjusting said left and right pair of binaural output signals in unison to provide control of a perceived distance.

19. The method of claim 11, wherein said step of playing back said left and right pair of binaural output signals comprises pitch shifting to controllably shift the pitch of said binaural output pair while maintaining the desired three-dimensional spatial coordinate position.

* * * * *